US011920452B1

(12) United States Patent
Bair et al.

(10) Patent No.: US 11,920,452 B1
(45) Date of Patent: Mar. 5, 2024

(54) DOWNHOLE SAND SEPARATOR

(71) Applicant: Black Gold Pump and Supply, inc., Signal Hill, CA (US)

(72) Inventors: Michael Bair, Los Angeles, CA (US); Simon Shin, Los Angeles, CA (US); Bao Binh H Nguyen, Los Angeles, CA (US)

(73) Assignee: Black Gold Pump and Supply, Inc., Signal Hill, CA (US)

( * ) Notice: Subject to any disclaimer, the term of this patent is extended or adjusted under 35 U.S.C. 154(b) by 0 days.

(21) Appl. No.: 18/375,819

(22) Filed: Oct. 2, 2023

(51) Int. Cl.
*E21B 43/38* (2006.01)
*E21B 43/34* (2006.01)

(52) U.S. Cl.
CPC ..... *E21B 43/38* (2013.01); *E21B 43/35* (2020.05)

(58) Field of Classification Search
CPC ..... E21B 43/35; E21B 43/38
See application file for complete search history.

(56) References Cited

U.S. PATENT DOCUMENTS 5,810,081 A * 9/1998 Cobb ..... E21B 17/00 166/105.3
10,107,088 B2 10/2018 Stachowiak et al.
11,661,833 B1 * 5/2023 Meier ..... B04C 5/06 299/8
2017/0266586 A1 * 9/2017 Hopper ..... B04C 5/08
2019/0106973 A1 * 4/2019 Ayub ..... E21B 43/128

* cited by examiner

*Primary Examiner* — David Carroll
(74) *Attorney, Agent, or Firm* — James M. Duncan; Scanlon Duncan LLP

(57) ABSTRACT

A downhole separator separates solids from an inflow of downhole fluid resulting in a cleansed fluid which is directed to the intake of a subsurface pump. The downhole separator has a separator unit which has a sleeve member with a liner member disposed within the sleeve member, the liner member having an exterior surface immediately adjacent the inner surface of the sleeve member. The sleeve member has an opening which is aligned with an opening in the sleeve liner to form an inlet. A vortex guide is disposed inside an inner surface of the liner member. The vortex guide has a helical exterior which is in engaging contact of the inner surface, wherein a single helical passage is formed which extends from the inlet to a second end of the vortex guide.

20 Claims, 7 Drawing Sheets

DOWNHOLE SAND SEPARATOR

BACKGROUND OF THE INVENTION

The present invention generally pertains to downhole oilfield production equipment. It more specifically refers to equipment used for downhole oilfield fluid production and solids control for downhole rod operated pumps.

Rod pumps are the most common form of artificial lift for oil production from subsurface reservoirs. A typical rod pump system consists of a prime mover, a surface rod actuation apparatus (such as a beam pumping unit), a sucker rod string, and a downhole pump. However, a known problem of downhole pumps is that sand and/or other particulate matter can cause the pump to fail. For example, particulates and solids will cause wear in the plunger as it reciprocates with respect to the pump barrel, resulting in a loss of efficiency. Excessive solids can actually cause the plunger to become stuck within the barrel. Solids can accumulate in the dead zone between the traveling valve and standing valve of the pump, resulting in sand accumulation in the barrel which can prevent fluid flow into the barrel. Solids and particulates can interfere with the seal between the balls and seats of the valves, resulting in reduced pump performance or complete pump failure. Solids and particulates generally result in erosion of all pump components and pump degradation over time.

As can be appreciated from the above paragraph, preventing and/or controlling the entry of sand and/or other particulate matter into the mechanisms of the downhole pump is desirable. A variety of solutions to this problem have been proposed over the years, including varieties of downhole sand separators through which downhole fluids are directed prior to flow into the pump barrel. However, the prior art downhole sand separators have designs which differ from the presently proposed solution. First, the prior art separators utilize designs which reduce the overall velocity of the fluid through the separator which can adversely impact the separation efficiency. Second, the known downhole separators are fabricated from metallic materials which are subject to erosion of the material and which also results in required tolerances between the exterior surfaces of the internal components and the interior surfaces of the external components resulting in a loss of efficiency.

SUMMARY OF THE INVENTION

A downhole sand separator is disclosed herein which meets the above-identified need. An embodiment of the sand separator receives an inflow of a downhole fluid and separates particulate matter from the inflow, resulting in a cleansed fluid which is directed to the intake of a subsurface pump while a particulate matter comprising sand and other solids is discharged from the separator. For purposes of this disclosure, the term "cleansed fluid" refers to a fluid from which at least some solids and/or particulate matter have been removed prior to being directed to the intake of the downhole pump.

The downhole sand separator may be configured as a separation unit comprising a sleeve member and a liner member disposed inside the sleeve member. The sleeve member has an upper end and a lower end with an outer opening adjacent the upper end. The outer opening penetrates through a wall of the sleeve member. The liner member has an exterior surface which is engaging contact with an interior of the sleeve member. The liner member further has an interior surface. The liner member has an inner opening which penetrates through the exterior to the interior surface. The inner opening in the liner member is positioned to be aligned with the outer opening of the sleeve member, such that the aligned outer opening and inner opening comprise an inlet to the interior of the liner member. The liner member may be fabricated from thermoplastic materials, including nylon for low temperature applications and polyether ether keytone (PEEK) for high temperature applications. Both materials are resistant to both sand abrasion and corrosion.

The separation unit further comprises a vortex guide which is positioned inside the interior surface of the liner member. The vortex guide has a first end and a second end. An axial opening extends from the first end to the second end. The vortex guide further comprises a helical exterior structure. The helical exterior structure is configured to be in engaging contact with the interior surface of the liner member. When so positioned, a single helical passage is formed by the engagement of the helical exterior structure with the interior surface of the liner member. The inlet formed by the alignment of the outer opening with the inner opening may form the beginning of the single helical passage. An outlet of the single helical passage is formed adjacent the second end of the vortex guide where the helical exterior structure terminates. The outer opening may be a tangentially oriented rectangular opening through the wall of the sleeve member, while the inner opening may likewise be a tangentially oriented rectangular opening through the liner member.

The vortex guide may also be fabricated from thermoplastic materials, including nylon for low temperature applications and polyether ether keytone (PEEK) for high temperature applications. Sand separators having components fabricated from steel have, by necessity, a gap between the inner diameter of the sleeve and outside diameter of the vortex guide, resulting in a loss of efficiency. However, because the thermoplastics expand in heat, the embodiments of the present invention which utilize thermoplastic for the components had a 100 percent seal between the surfaces of the components, thereby maximizing efficiency.

The separation unit may be assembled with other components to form a separator assembly. For example, a mandrel may be attached to the lower end of the sleeve member, the mandrel having a top end, a bottom end, and an axial opening extending through the mandrel from the top end to the bottom end, where the axial opening is configured for a flow of the cleaned fluid. A dump valve, which may comprise a ball and seat disposed within a valve cage, may be attached to the bottom end of the mandrel or a sand collection extension may be disposed between the bottom end of the mandrel and the dump valve to provide a dead zone away from the vortex guide to facilitate the gravitation of the solids to the dump valve. The dump valve is configured to release the particulate discharge from the separator assembly upon an opening of the dump valve, which occurs on the downstroke of the subsurface pump, when the ball in the dump valve falloff the seat. On the upstroke of the subsurface pump the ball is lifted and seals against the seat. The dump valve may be set within an optional protective sleeve.

In operation, an inflow of downhole fluid with entrained solids enters the inlet and travels through the single helical passage, creating centrifugal forces which drives the solids to the outside of the helical passage, separating the solids from the downhole fluid, resulting in the cleansed fluid. The cleansed fluid flows up through the axial opening of the thermoplastic vortex guide where it flows out of the top of the separation module and drawn into the pump intake upon the upstroke of the downhole pump. The solids flow out through the bottom of the separation module and are discharged from the separator through a dump valve at the bottom of the separator assembly upon the downstroke of the downhole pump.

DETAILED DESCRIPTION OF THE EMBODIMENTS

Figure 1:
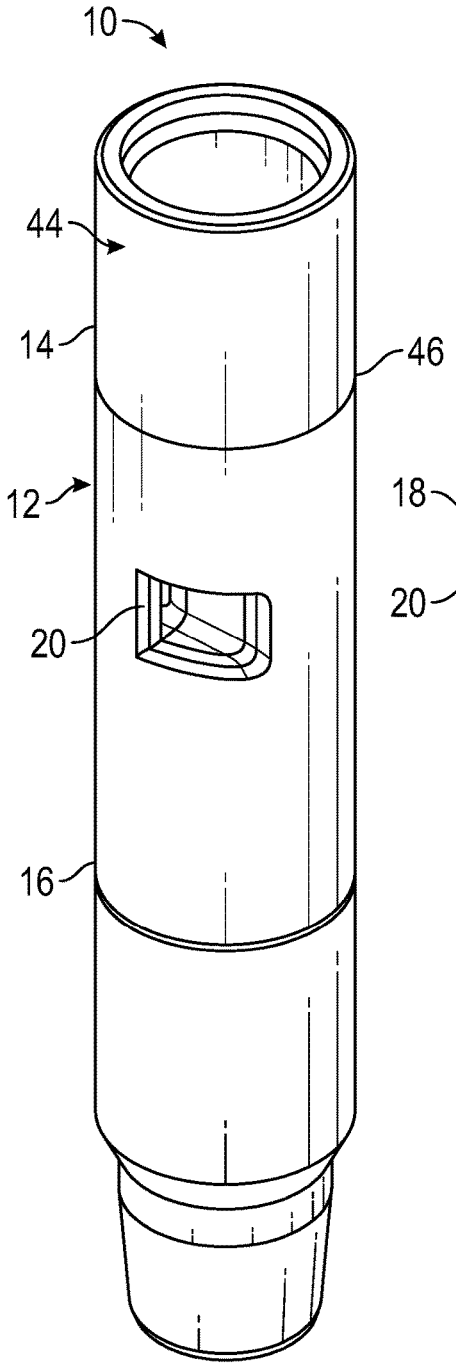
FIG. 1 shows a perspective view of an embodiment of the separator unit of the disclosed downhole sand separator.
Figure 2:
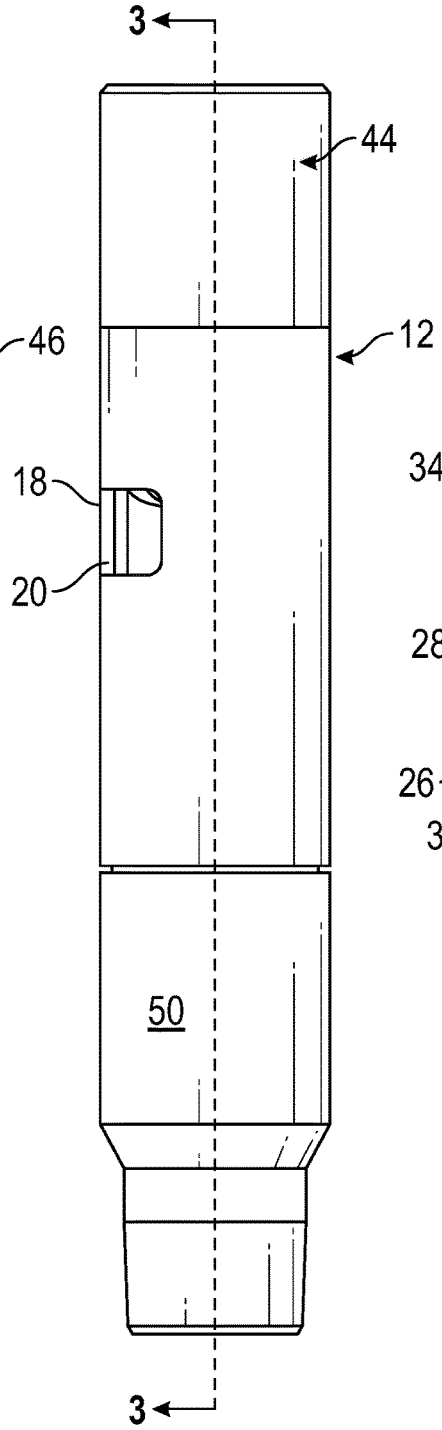
FIG. 2 shows a side view of an embodiment of the separator unit of the disclosed downhole sand separator.
Figure 3:
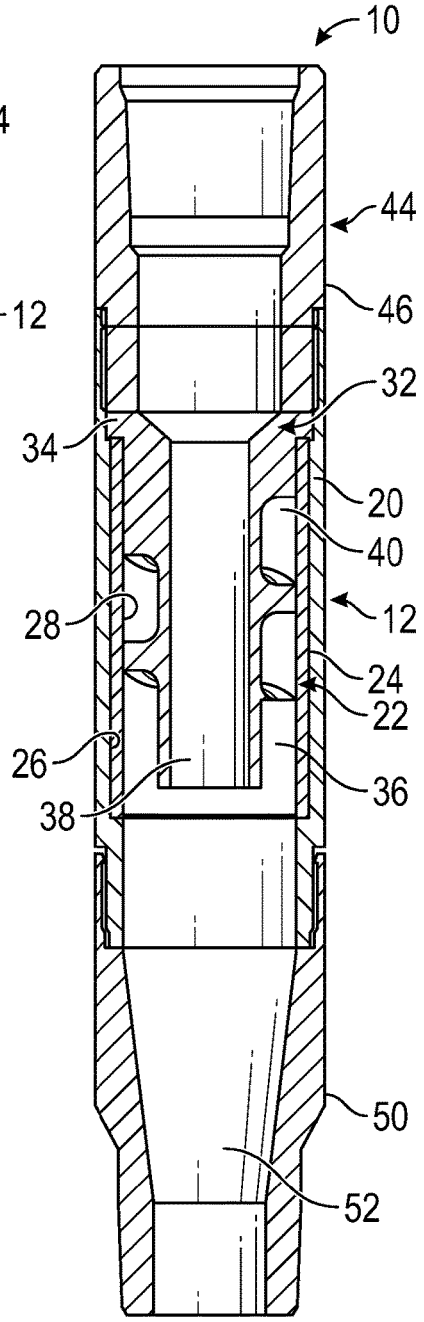
FIG. 3 shows sectioned view taken along line 3-3 of FIG. 2.
Figure 6:
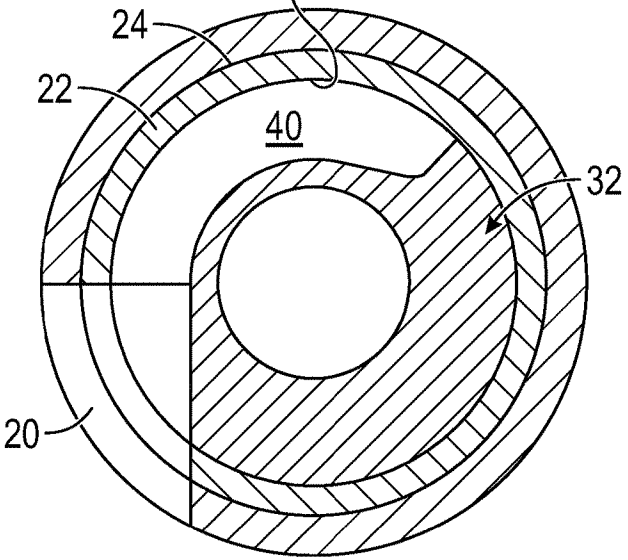
FIG. 6 shows a sectioned view taken along line 6-6 of FIG. 5.
Figure 5:
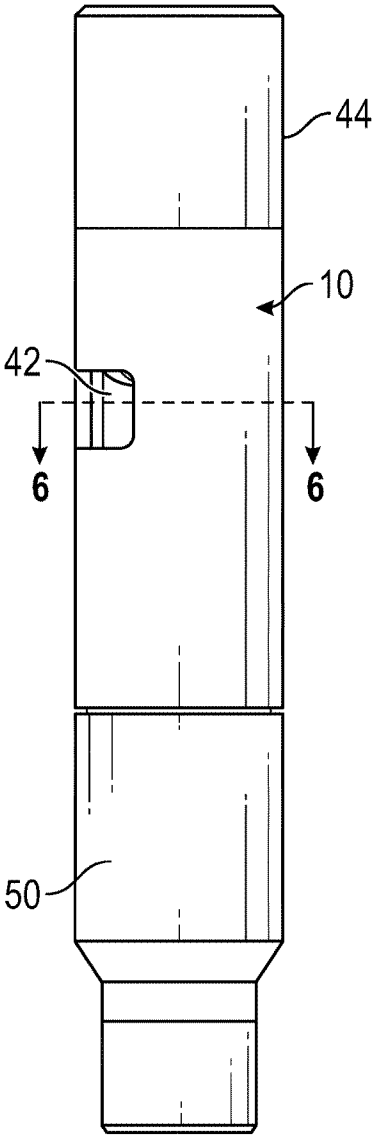
FIG. 5 shows a side view of an embodiment of the separator unit.
Figure 4:
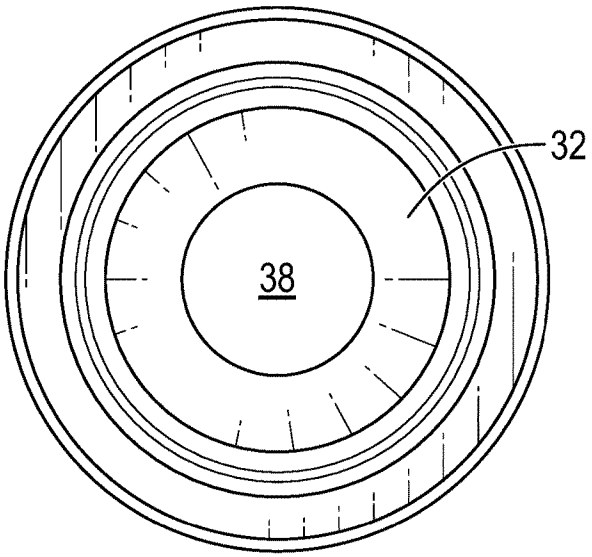
FIG. 4 shows a top view of the embodiment of the separator unit shown in FIGS. 1-3.
Figure 7:
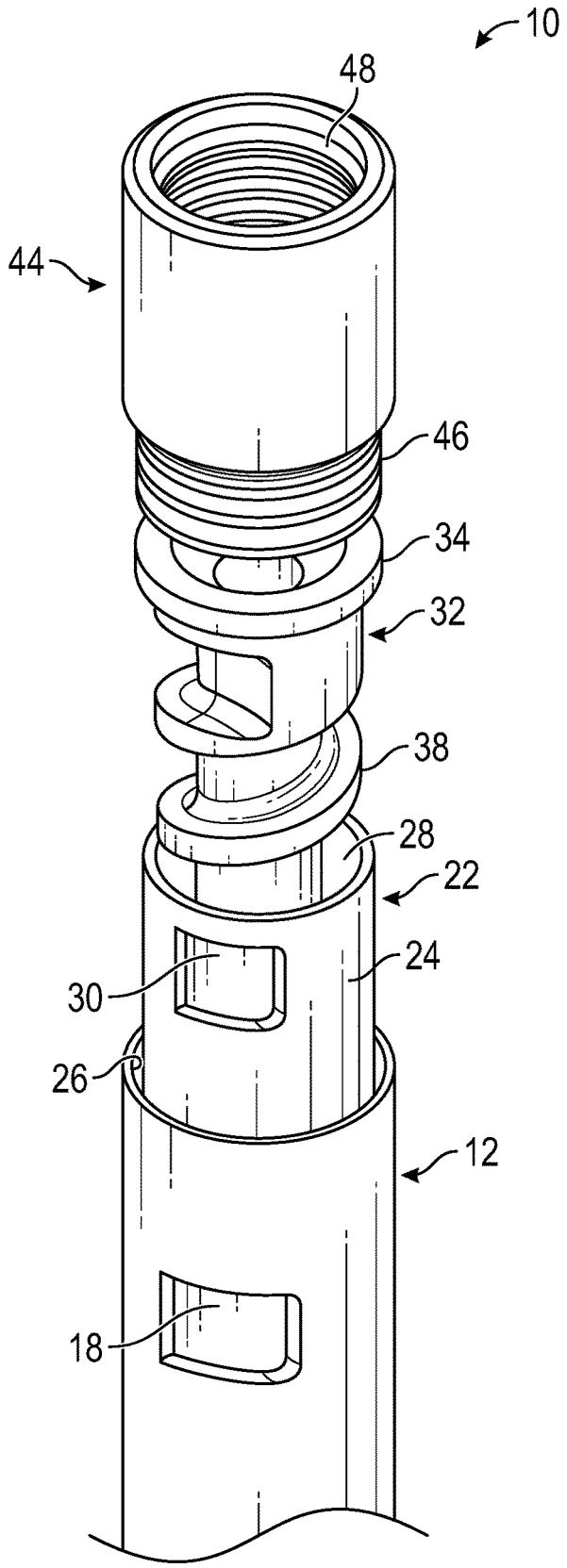
FIG. 7 shows a perspective view of a partially exploded view of an embodiment of the separator unit.

Referring now to the figures, FIGS. 1 through 7 show an embodiment of a separator unit 10 which may be utilized in embodiments of a downhole sand separator which is utilized with a subsurface pump in an oilwell. The separation unit 10 has a sleeve member 12 having an upper end 14, a lower end 16, and an opening 18 adjacent the upper end, where the opening 18 penetrates through a wall 20 of the sleeve member 12.

The separator unit 10 also has a liner member 22 disposed inside the sleeve member 12. The liner member 22 has an exterior surface 24 immediately adjacent an inner surface 26 of the sleeve member 12. Liner member 22 has an interior surface 28. The liner member 22 has an opening 30 which penetrates through the exterior surface 24 to the interior surface 28. When the separator unit has been assembled, the opening 30 in liner member 22 aligns with the opening 18 of the sleeve member, to form a single inlet in the separator unit 10.

The separator unit 10 also has a vortex guide 32 which is disposed inside the interior surface 28 of the liner member 22. The vortex guide 32 has a first end 34 and a second end 36, and an axial opening 38 which extends from the first end 34 to the second end 36. The vortex guide 32 has a helical exterior 38 which is configured to be in engaging contact with the interior surface 28 of the liner member 22. When the vortex guide 32 has been installed inside the liner member 22, the engaging contact of the helical exterior 38 with the interior surface 28 of the liner member 22, a single helical passage 40 is formed between the interior surface 28 and the helical exterior 38. The helical passage 40 extends from the single inlet 42 formed by the alignment of the opening 30 in the liner member 22 with the opening 18 of the sleeve member 12 to the second end 36 of the vortex guide 32.

As shown in the figures opening 18 may be configured as a tangentially oriented rectangular opening which penetrates through the wall 20 of the sleeve member 12 which is aligned with opening 30 of the liner member 22, which may also be configured as a tangentially oriented rectangular opening penetrating through the liner member 40.

Figure 8:
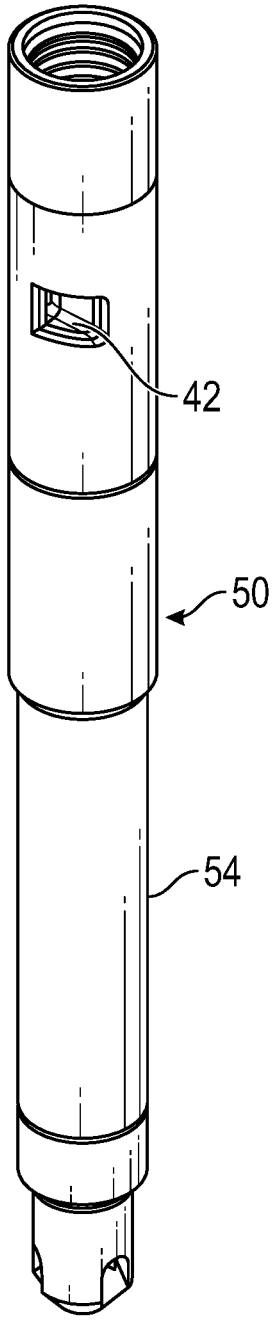
FIG. 8 shows a perspective view of a complete sand separator of the present invention.
Figure 9:
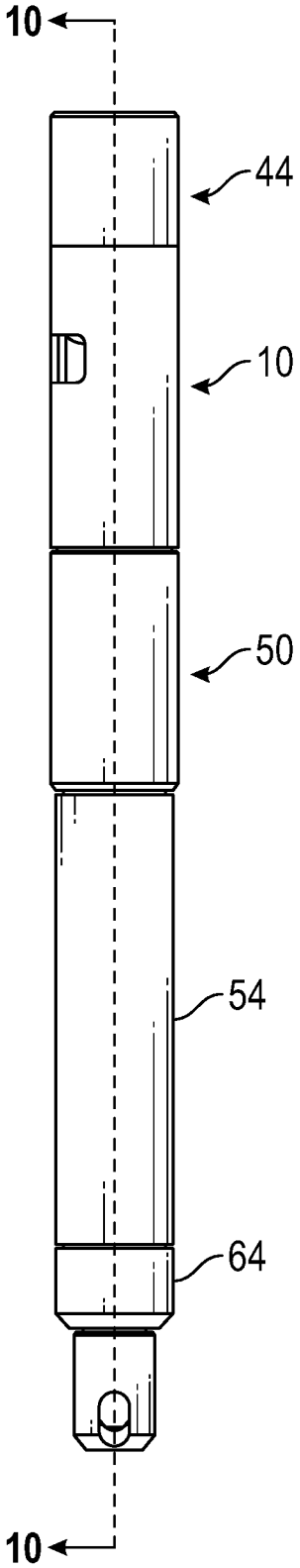
FIG. 9 shows a side view of a complete sand separator of the present invention.
Figure 10:
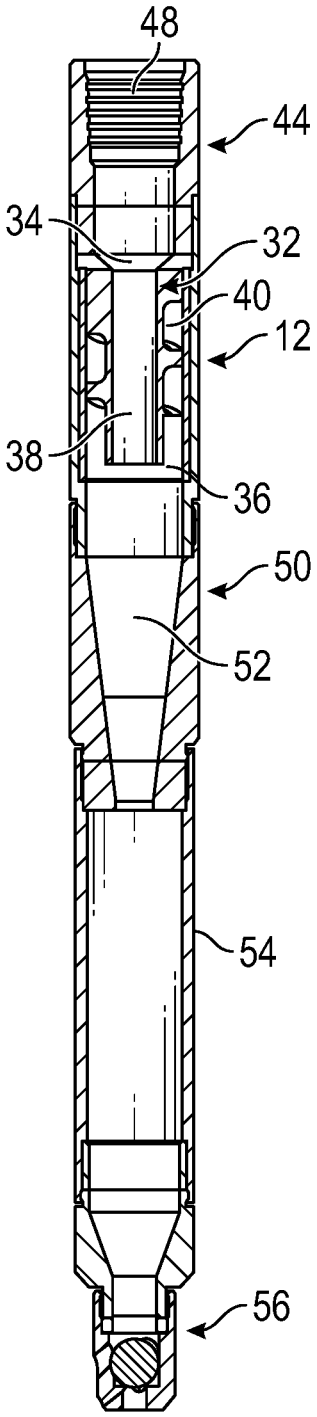
FIG. 10 shows a sectioned view taken along line 10-10 of FIG. 9.
Figure 11:
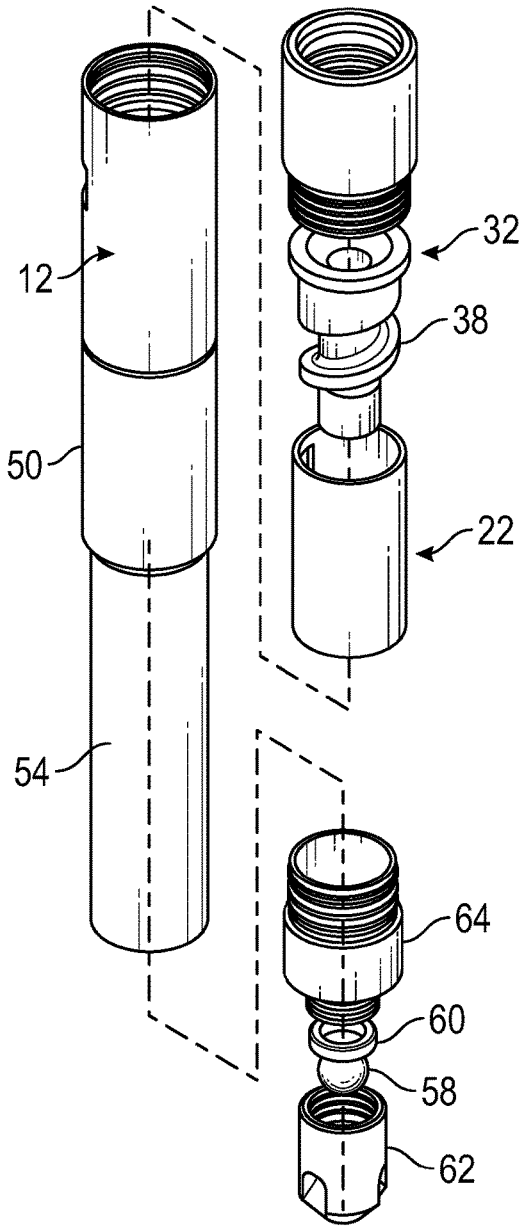
FIG. 11 shows a perspective exploded view of the complete sand separator of FIGS. 8-10
Figure 12:
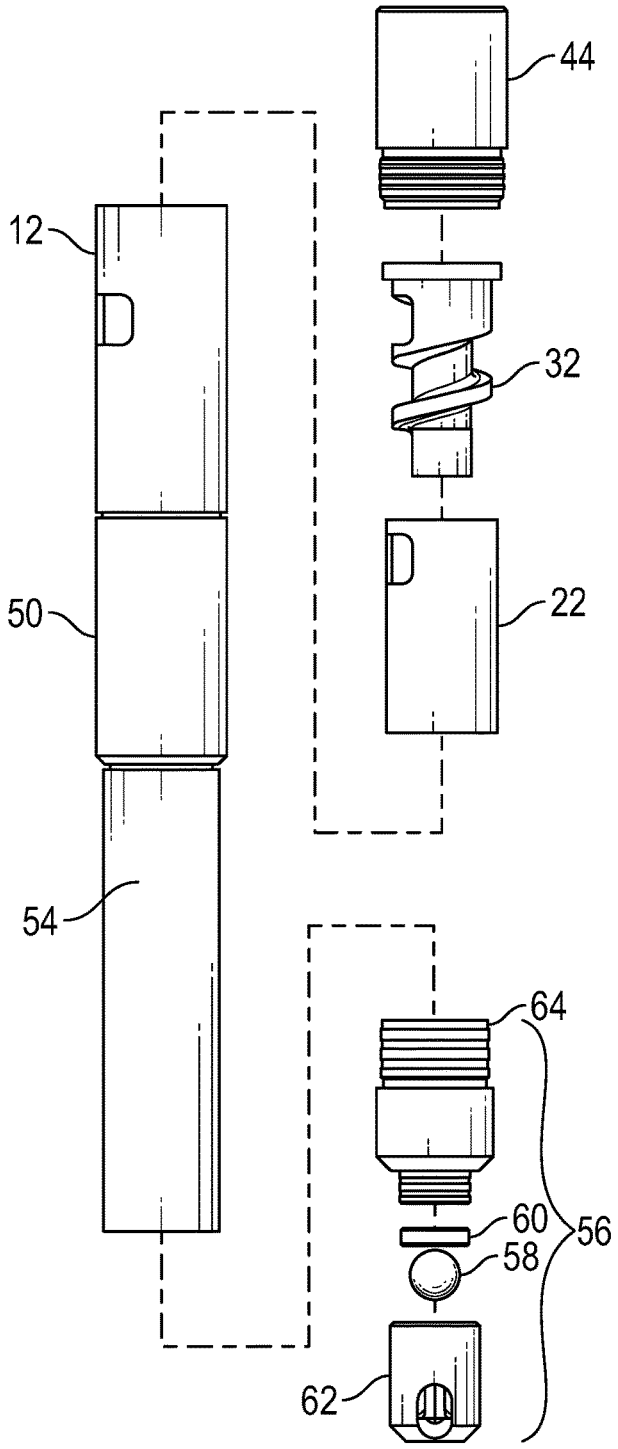
FIG. 12 shows a side exploded view of the complete sand separator of FIGS. 8-10.
Figure 13:
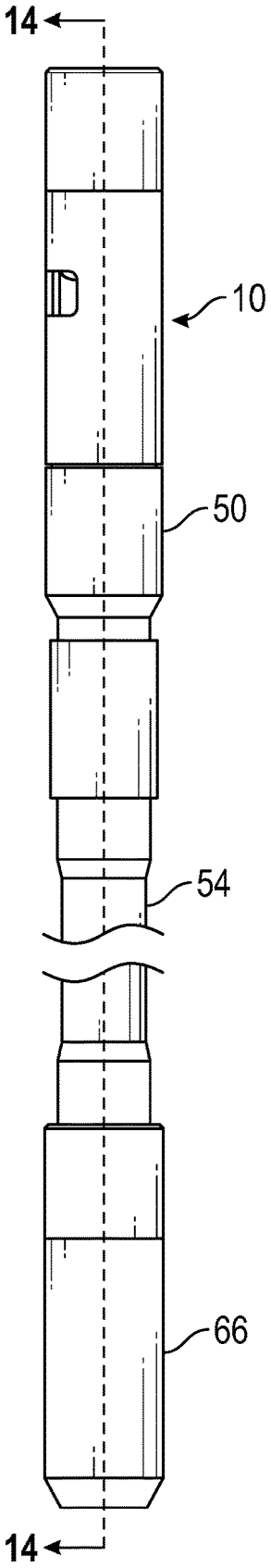
FIG. 13 shows a side view of an embodiment of a complete sand separator having a protective sleeve around the dump valve.
Figure 14:
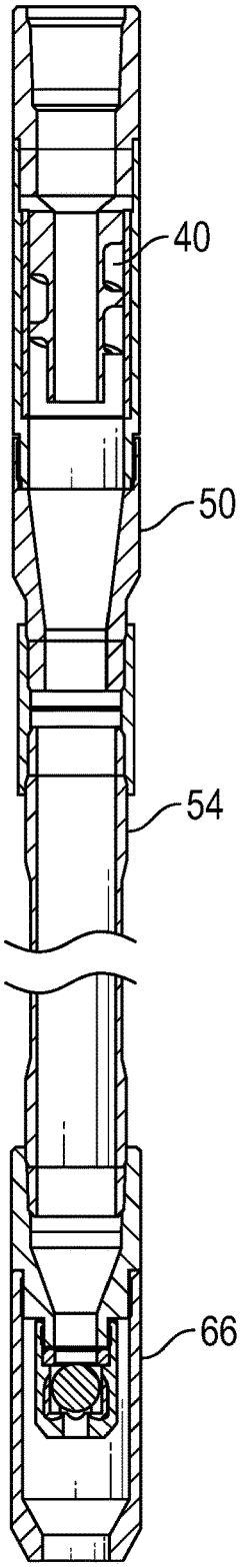
FIG. 14 shows a sectioned view taken along line 14-14 of FIG. 13.
Figure 15:
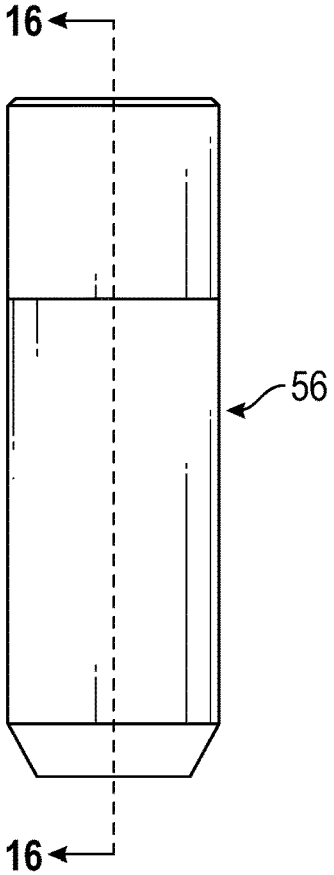
FIG. 15 shows a side view of an embodiment of a protective sleeve.
Figure 16:
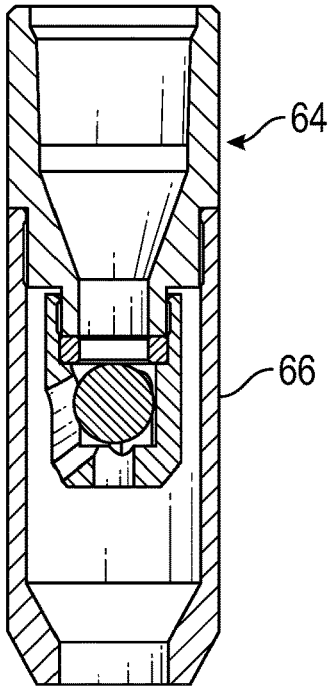
FIG. 16 shows a sectioned view taken along line 16-16 of FIG. 15.
Figure 17:
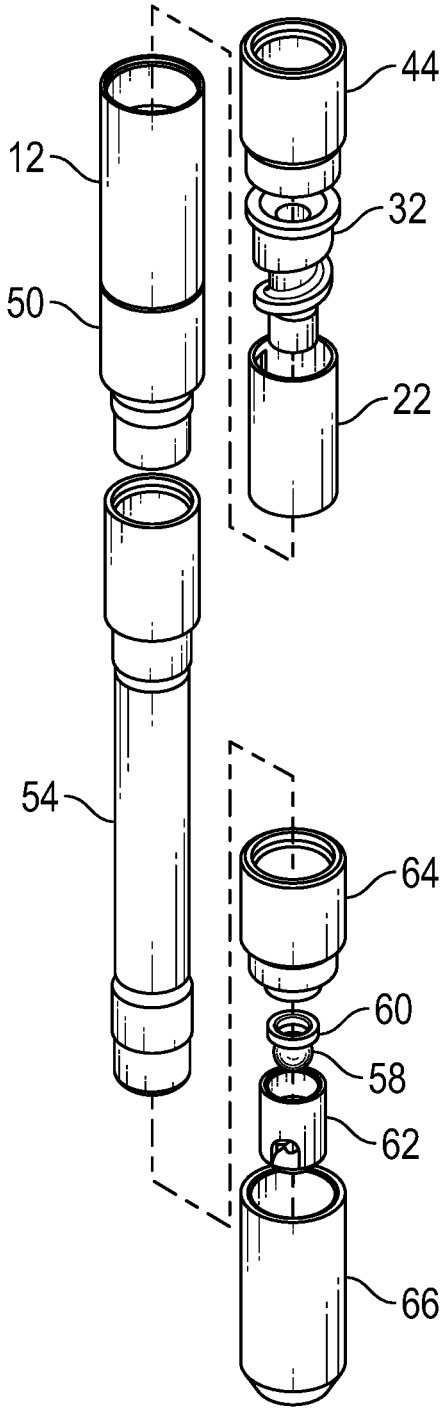
FIG. 17 shows a perspective view of the complete sand separator of FIGS. 13-14.
Figure 18:
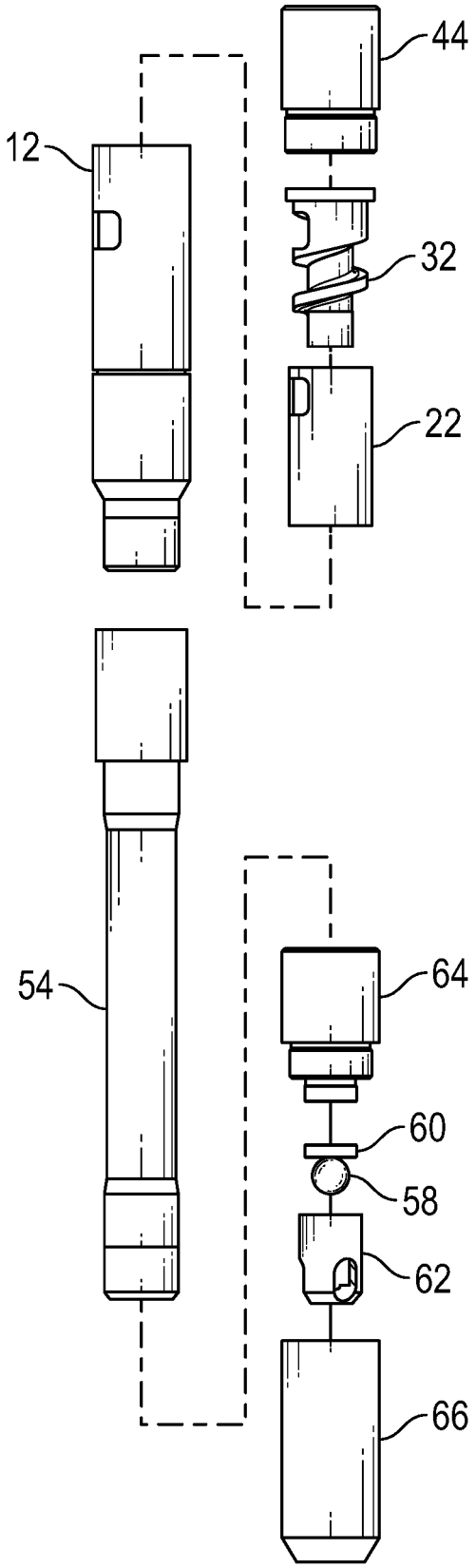
FIG. 18 shows a side exploded view of the complete sand separator of FIGS. 13-14.

FIGS. 8 through 14, 17 and 18 depict embodiments of complete sand separators. The complete sand separator includes as an essential component the sand separator unit 10. The separator unit 10 may be attached to a lower end 46 of an adapter 44. Adapter 44 may have an upwardly facing threaded end 48. A sand separator mandrel 50 may be attached to a lower end 52 of the separator unit 10. Sand separator mandrel 50 may have a tapered interior passage 52 which guides separated solids downward. A sand collection extension 54 may be attached to the lower end of sand separator mandrel 50. Sand collection extension 54 provides for additional storage of separated solids until the solids can be discharged through dump valve 56. Dump valve 56 may have a ball 58 which seals against seat 60, with the ball contained within cage 62. Dump valve 56 may attach to sand collection extension 54 with connector 64. Dump valve 56 may be protected with a protector sleeve 66 which has an open end to allow the discharge of solids. The solids flow out through the bottom of the protector sleeve and are discharged from the separator through a dump valve at the bottom of the separator assembly upon the downstroke of the downhole pump.

The liner member 22 and the vortex guide 32 may be fabricated from thermoplastic materials. The use of thermoplastic materials which eliminates any gap between the inner surface 28 of the liner member 22 and the helical exterior 38 because the thermoplastic materials expand when heated. This feature increases the efficiency of the separator because the opposing thermoplastic surfaces provide a 100% seal when heated. In low temperature applications, the thermoplastic material may be nylon. In higher temperature applications, the thermoplastic material may be fabricated from PEEK.

What is claimed is:

1. A separation unit for receiving an inflow of a downhole fluid and separating a particulate matter from said inflow resulting in a cleansed fluid and a particulate discharge, said separation unit comprising:

a sleeve member comprising an upper end, a lower end, and an outer opening adjacent the upper end, the outer opening penetrating through a wall of the sleeve member;

a liner member disposed inside the sleeve member, the liner member comprising an exterior surface adjacent an inner surface of the sleeve member, the liner member further comprising an interior surface, said liner member having an inner opening penetrating through the exterior surface to the interior surface, the inner opening disposed in aligned relation with the outer opening of the sleeve member wherein the aligned outer opening and inner opening comprise a single inlet;

a vortex guide disposed inside the interior surface of the liner member, the vortex guide having a first end and a second end and an axial opening extending from the first end to the second end, wherein the vortex guide further comprises a helical exterior, said helical exterior configured to be in engaging contact with the interior surface of the liner member resulting in a single helical passage between the interior surface of the liner member and the helical exterior of the vortex guide, said helical passage extending from the single inlet to the second end of the vortex guide.

2. The separation unit of claim 1 wherein the liner member is fabricated from thermoplastic.

3. The separation unit of claim 1 wherein the vortex guide is fabricated from thermoplastic.

4. The separation unit of claim 1 wherein the liner member is fabricated from nylon.

5. The separation unit of claim 1 wherein the vortex guide is fabricated from nylon.

6. The separation unit of claim 1 wherein the liner member is fabricated from polyether ether keytone.

7. The separation unit of claim 1 wherein the vortex guide is fabricated from polyether ether keytone.

8. The separation unit of claim 1 wherein the outer opening is a first tangentially oriented rectangular opening through the wall of the sleeve member and the inner opening is a second tangentially oriented rectangular opening through the liner member.

9. A separation unit for receiving an inflow of a downhole fluid and separating a particulate matter from said inflow resulting in a cleansed fluid and a particulate discharge, said separation unit comprising:

an adapter having an upwardly facing threaded end and a lower end;

a sleeve member attached to the lower end of the adapter, the sleeve member comprising an upper end and a lower end;

a thermoplastic liner member disposed inside the sleeve member, the thermoplastic liner member comprising an exterior in engaging contact with an interior of the sleeve member, the thermoplastic liner member further comprising an interior surface; and a thermoplastic vortex guide disposed inside the interior surface of the thermoplastic liner member, the thermoplastic vortex guide having a first end and a second end and an axial opening extending from the first end to the second end, wherein the thermoplastic vortex guide further comprises a helical exterior, said helical exterior configured to be in engaging contact with the interior surface of the thermoplastic liner member resulting in a single helical passage between the interior surface of the liner member and the helical exterior of the vortex guide, said helical passage extending from a single inlet at the upper end of the sleeve member to an outlet adjacent the second end of the vortex guide.

10. The separation unit of claim 9 wherein the single inlet comprises an outer opening adjacent the upper end of the sleeve member in aligned configuration with an inner opening of the thermoplastic liner member, wherein the inner opening penetrates through the exterior of the thermoplastic liner member to the interior surface, wherein the outer opening is a first tangentially oriented rectangular opening through the wall of the sleeve member and the inner opening is a second tangentially oriented rectangular opening through the liner member.

11. The separation unit of claim 9 wherein the liner member is fabricated from nylon.

12. The separation unit of claim 9 wherein the vortex guide is fabricated from nylon.

13. The separation unit of claim 9 wherein the liner member is fabricated from polyether ether keytone.

14. The separation unit of claim 9 wherein the vortex guide is fabricated from polyether ether keytone.

15. A separator assembly for receiving an inflow of a downhole fluid and separating a particulate matter from said inflow resulting in a cleansed fluid and a particulate discharge, said separator assembly comprising:

an adapter having an upwardly facing threaded end and a lower end;

a separation unit comprising a sleeve member, the separation unit attached to the lower end of the adapter, a thermoplastic liner member disposed inside the sleeve member, the sleeve member having an upper end and a lower end, the thermoplastic liner member comprising an exterior in engaging contact with an interior of the sleeve member, the thermoplastic liner member further comprising an interior surface, the separation module further comprising a thermoplastic vortex guide disposed inside the interior surface of the thermoplastic liner member, the thermoplastic vortex guide having a first end and a second end and an axial opening extending from the first end to the second end, wherein the thermoplastic vortex guide further comprises a helical exterior, said helical exterior configured to be in engaging contact with the interior surface of the thermoplastic liner member resulting in a single helical passage between the interior surface of the liner member and the helical exterior of the vortex guide, said helical passage extending from an inlet at the upper end of the sleeve member to an outlet adjacent the second end of the thermoplastic vortex guide;

a mandrel attached the lower end of the sleeve member, said mandrel comprising a top end, a bottom end, and an axial opening extending through the mandrel from the top end to the bottom end, said axial opening configured for a flow of the cleansed fluid; and a dump valve comprising a ball and seat disposed within a cage, said cage attached to the bottom end of the mandrel, the dump valve configured to release the particulate discharge from the separator assembly upon the ball lifting off of the seat.

16. The separator assembly of claim 15 wherein the inlet comprises an outer opening adjacent the upper end of the sleeve member in aligned configuration with an inner opening of the thermoplastic liner member, wherein the inner opening penetrates through the exterior of the thermoplastic liner member to the interior surface, wherein the outer opening is a first tangentially oriented rectangular opening through the wall of the sleeve member and the inner opening is a second tangentially oriented rectangular opening through the liner member.

17. The separation unit of claim 15 wherein the liner member is fabricated from nylon.

18. The separation unit of claim 15 wherein the vortex guide is fabricated from nylon.

19. The separation unit of claim 15 wherein the liner member is fabricated from polyether ether keytone.

20. The separation unit of claim 15 wherein the vortex guide is fabricated from polyether ether keytone.

* * * * *